US012753558B2

(12) United States Patent
Shin

(10) Patent No.: US 12,753,558 B2
(45) Date of Patent: Oct. 6, 2026

(54) BARRIER POST WITH SAFETY MEANS

(71) Applicant: ANS DEVELOPMENT CO., LTD., Seoul (KR)

(72) Inventor: Dong Ahn Shin, Seoul (KR)

(73) Assignee: ANS DEVELOPMENT CO., LTD., Seoul (KR)

( * ) Notice: Subject to any disclaimer, the term of this patent is extended or adjusted under 35 U.S.C. 154(b) by 527 days.

(21) Appl. No.: 18/234,669

(22) Filed: Aug. 16, 2023

(65) Prior Publication Data

US 2024/0060256 A1 Feb. 22, 2024

(51) Int. Cl.
*E01F 13/02* (2006.01)

(52) U.S. Cl.
CPC ..... *E01F 13/028* (2013.01)

(58) Field of Classification Search
CPC ..... E01F 13/02; E01F 13/028
USPC ..... 256/1
See application file for complete search history.

(56) References Cited

U.S. PATENT DOCUMENTS 6,375,164 B1 * 4/2002 Siegler ..... E01F 13/028 256/1
8,881,787 B2 * 11/2014 Wang ..... E06B 11/04 160/24
2003/0113519 A1 * 6/2003 Wasserman ..... C09J 133/06 428/40.1
2022/0136187 A1 * 5/2022 Thenemann ..... E04H 17/131
2022/0157206 A1 * 5/2022 Kay ..... E01F 13/028

FOREIGN PATENT DOCUMENTS

KR 20110010503 U 11/2011

* cited by examiner

*Primary Examiner* — William V Gilbert
(74) *Attorney, Agent, or Firm* — Maschoff Brennan

(57) ABSTRACT

A barrier post with safety means includes a barrier post fixed to a stand, with a cylindrical head mounted on an upper end of the barrier post. A belt wound on a spool in the head can be withdrawn from and inserted into the spool. A spring compresses when the belt is drawn out from the spool and acts on the spool to rewind the belt. Safety means reduce rotation of the spool to prevent an accident caused by the belt when the belt is rewound to the spool. The safety means includes two divided annular holders with multiple grooves on an inner space of the upper housing, and metal balls provided in grooves. Two locking parts protruding from an upper surface of an upper plate of the spool are formed between adjacent ends of the holders, so that the two holders may be rotated together with the spool.

2 Claims, 5 Drawing Sheets

BARRIER POST WITH SAFETY MEANS

TECHNICAL FIELD

The present invention relates to a barrier post with safety means, and in particularly, to an improved barrier post having safety means to prevent injury to surrounding people or damage by reducing a speed of a guide barrier when the guide barrier drawn from the head housing of the barrier post is rewound on a spool in the head housing.

BACKGROUND ART

Generally, a barrier post is used to prevent the occurrence of accidents or to maintain order by restricting the access of outsiders to various construction sites and work sites, or by guiding people to move through a predetermined route at the event site.

The barrier post is constructed such that the support rod is connected to a base member disposed on the ground, and the belt, strap, ribbon, or webbing embedded in the head housing provided on the top of the support rod is withdrawn as a passage guide means for people.

As an example of a barrier post, Korean Utility Model Pre-publication No20-2011-0010503 (published on Nov. 9, 2011) discloses a body including a post of which the lower end is supported by a stand and a belt housing fixed to the upper end thereof, a winding drum which is rotatably installed inside the belt housing, and a barrier belt retractably wound on the drum, and a winding force generating means to generate a winding force in the winding direction of the barrier belt, wherein the winding force generating means includes a pair of spiral springs installed in the top and bottom of the belt housing to reinforce the winding force of the barrier belt drawn out, the body further comprises upper and lower case connected to the belt housing, of which the upper case has the connection circumference protruded in the top surface, and the alarm means operated by the switch provided to the upper side of the connection circumference is further included.

However, in the prior art, when the belt drawn from the barrier post is inserted into the head of the adjacent barrier post and the end of the belt is removed from the adjacent barrier post after being used as a passage guide means, there is a problem that people adjacent to the barrier post may be injured or vehicles or fixtures may be damaged by the barrier belt or the handle provided at the end of the barrier belt in a process of suddenly rewinding the barrier belt by the restoring force of the spring as a winding force generating means.

Accordingly, the safety means is required to prevent sudden rewinding of the barrier belt.

PRIOR ART DOCUMENT

Korean Public Utility Model Announcement No. 20-2011-0010503 (published on Nov. 9, 2011)

DISCLOSURE OF THE INVENTION

Technical Problem

An object of the present invention is to provide the barrier post including the safety means in which a barrier belt speed is automatically decelerated when the barrier belt drawn out is rewound in the spool of the head housing provided to the support rod upper end of the barrier post in order to solve the problem in the prior art barrier posts described above.

Technical Solution

In order to achieve the above purpose, according to the present invention, the barrier post having a safety means comprises: a post fixed to a support; a cylindrical head mounted on an upper end of the post; a spool embedded in the head; a belt wound to be mounted on the head of the barrier post drawn out from the spool and adjacently arranged; and a spring applied to the spool to automatically rewind the belt drawn out by an elastic restoring force: wherein a top housing is arranged on the top plate of the spool and the safety means provided to the top housing is included to decelerate the rotation of the spool by the spring in order to prevent an accidental occurrence by the free end part of the belt when the belt rewinds with the force of restitution of the spring in the spool.

The safety means comprises two divided annular holders arranged in the inside space of the top housing, in which multiple grooves of the respective multiple are formed, and balls of the metal provided to the grooves of each holders.

When the spool revolves with the force of restitution of the spring, the holders move with the centrifugal force to the radius direction outer side of the balls of the metal arranged in the grooves of the holders to the radius direction outer side away from each other in order to adhere closely to the wall inner side of the respective top housing, whereby the rotation of the spool connected to the top housing slows down and the speed in which the drawn belt rewinds slows down.

In addition, an end part of the central shaft protrudes above the upper plate of the spool and is rotatably inserted into a boss extending downward from the central portion of the cover provided on the upper housing which is provided at the upper plate of the spool, so that the upper housing may be rotated upon rotating of the spool.

Effects of the Invention

The present invention has an effect that the holders move to the radius direction outer side with the centrifugal force of the balls provided to the groove of the holder mounted on the top housing connected in spool and it adheres closely to the wall inner side of the top Housing and the rewinding speed of the belt slows down to the rotation deceleration of spool and problem including the safety accident etc. is solved generated by the free end part when the conventional belt rewinds in spool.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

The present invention will be hereafter described in detail with reference to the accompanying drawings.

Hereinafter, the present invention will be described in detail with reference to the accompanying drawings illustrating an embodiment of the present invention.

Figure 1:
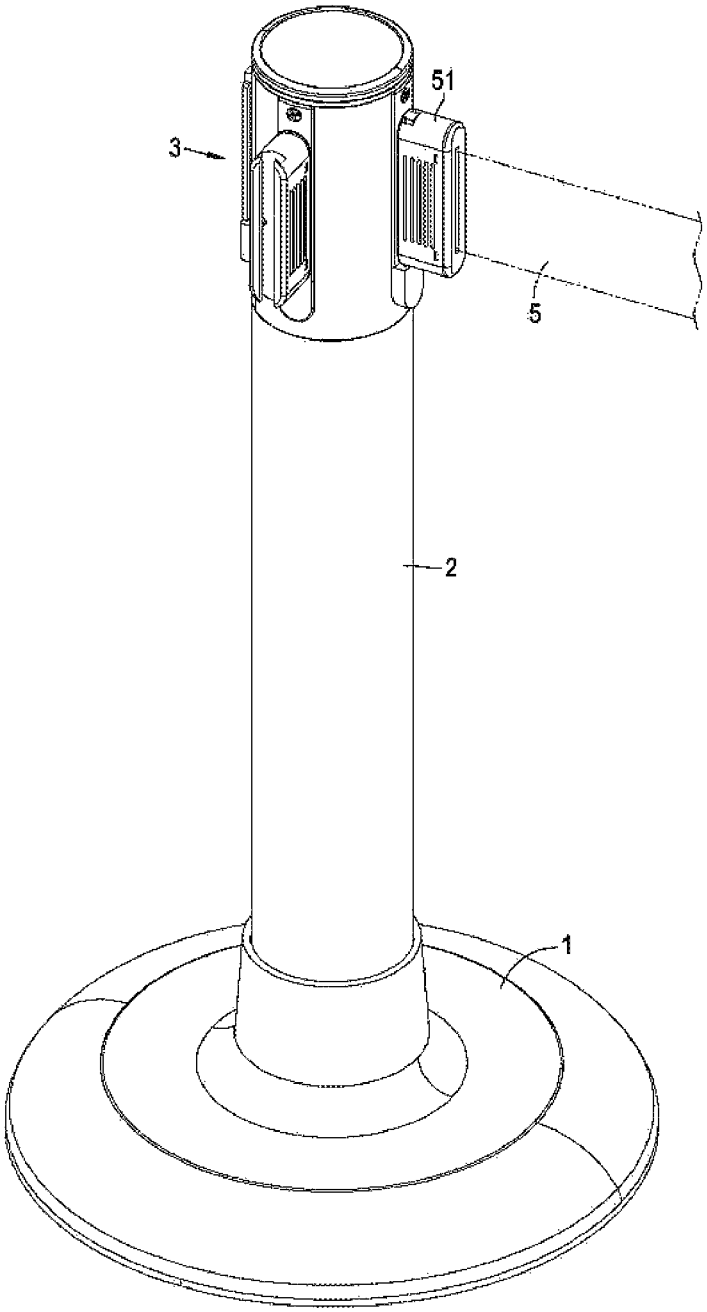
FIG. 1 is a schematic perspective view of a barrier post with safety means according to the present invention.
Figure 2:
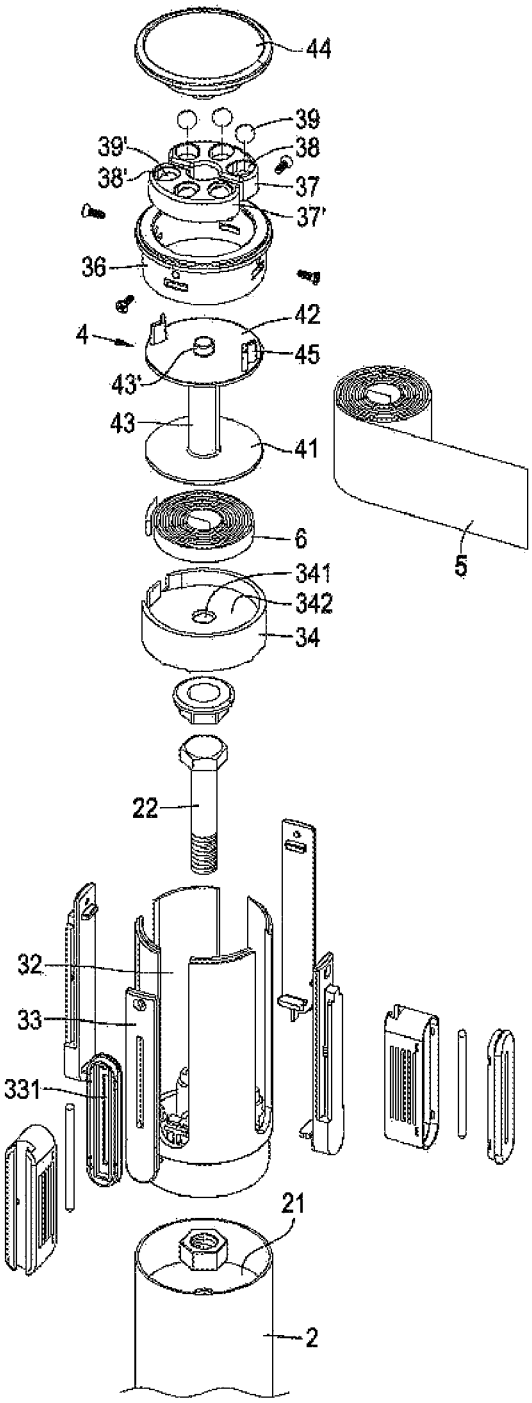
FIG. 2 is a schematic exploded perspective view of the head of the barrier post with safety means in FIG. 1.
Figure 3:
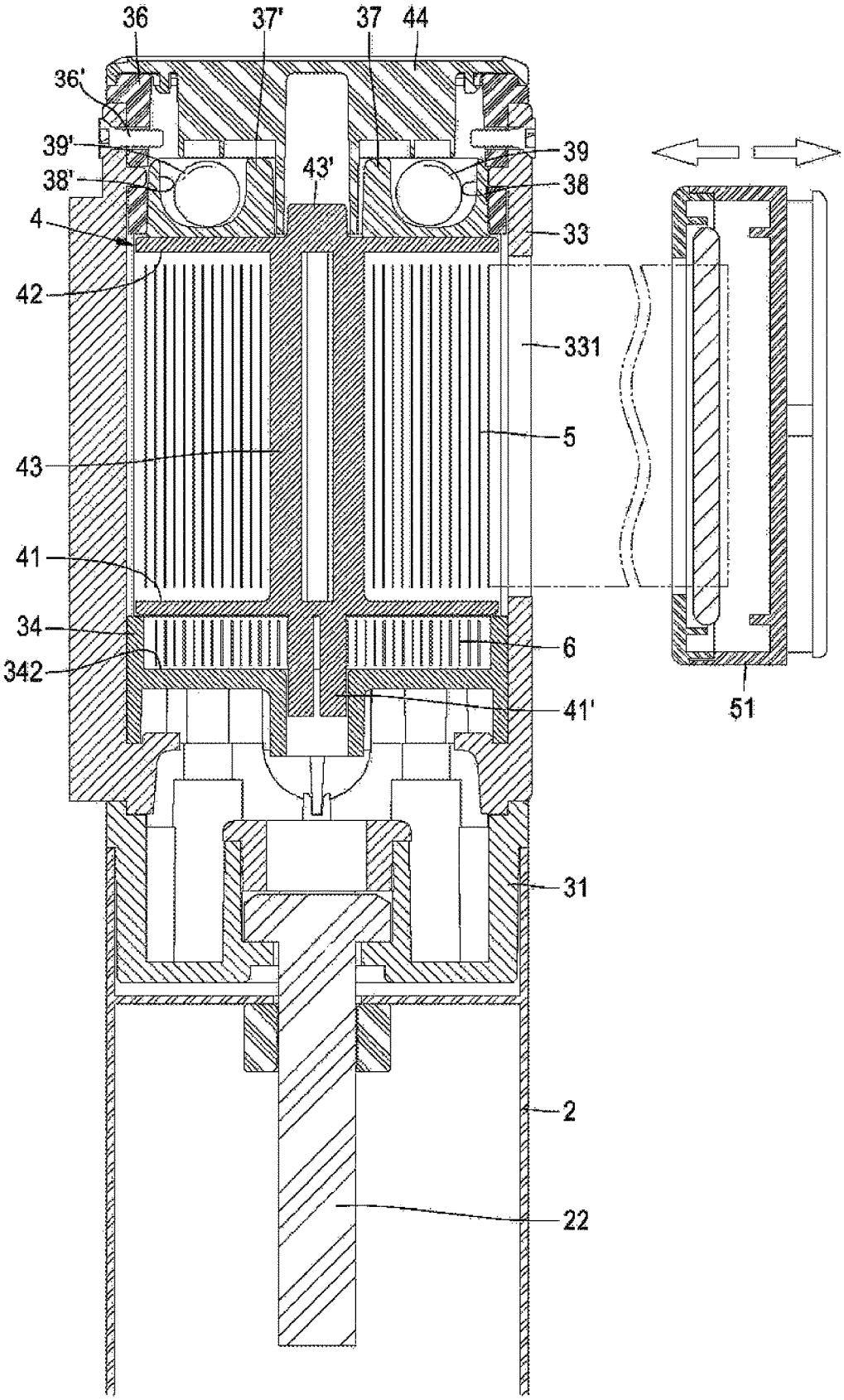
FIG. 3 is a schematic cross-sectional view of the head of the barrier post with safety means in FIG. 1.
Figure 4:
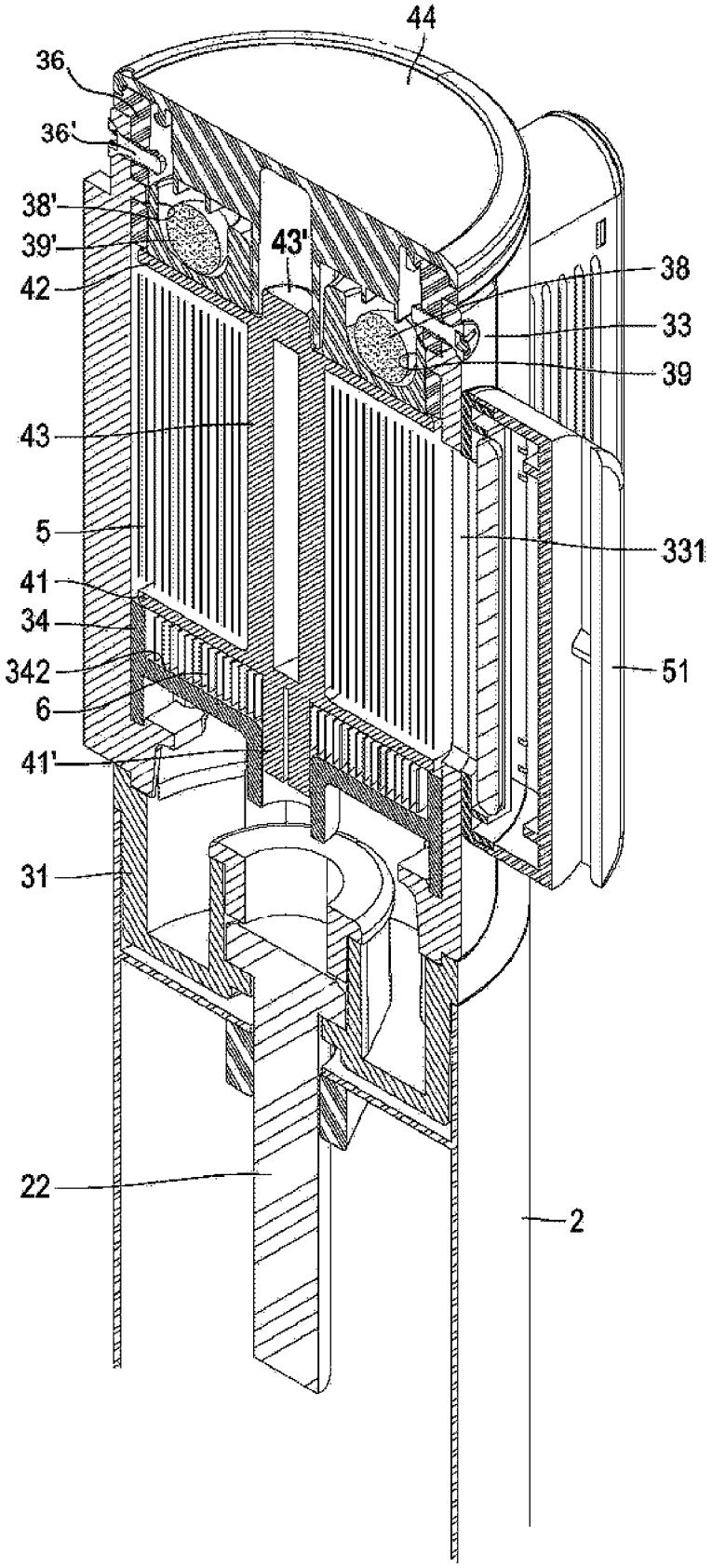
FIG. 4 is a cross-sectional view illustrating a state in which the belt is drawn out from the head of the barrier post with safety means in FIG. 1.
Figure 5:
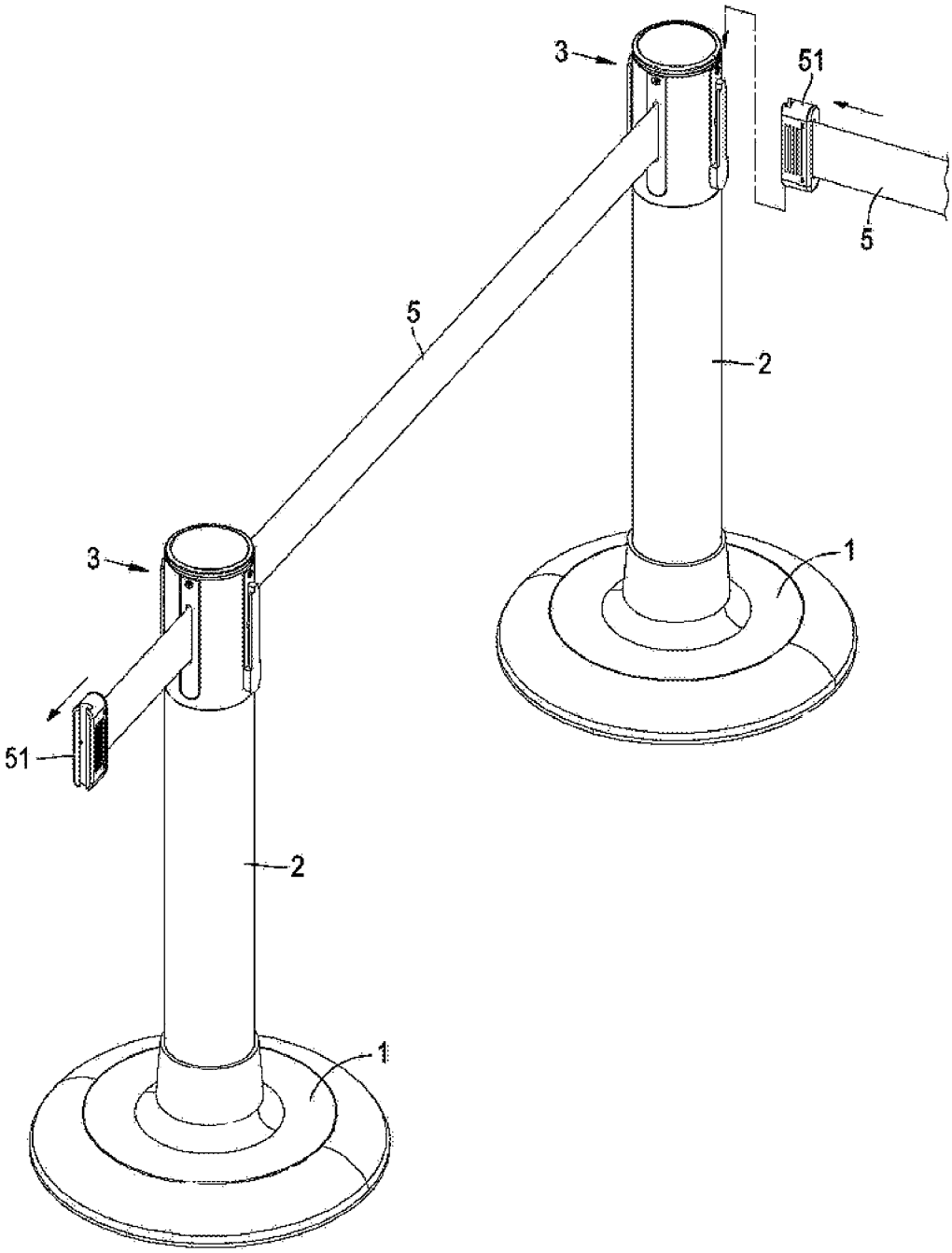
FIG. 5 is a schematic perspective view showing that the belt of which the end is inserted into the adjacent barrier post is drawn out from the barrier post with safety means in FIG. 1, and then the belt is rewound by the restoring force of the spring provided to the head.

Referring to FIGS. 1 to 3, according to the present invention, the barrier post with safety means comprises: a post(2) fixed to a stand(1); a cylindrical head(2) mounted on the top of the post; a spool(4) disposed in the head(3); a belt(5) wound around the spool(4) to be mounted on the head of the adjacent post with safety means arranged adjacent to the post; and a spring(6) acting on the spool so that the belt automatically rewinds to the spool when the belt(5) is drawn out. and safety means for decelerating the spool to prevent accidents caused by the free end of the belt(5) when the belt(5) is rewound to the spool(4) by the restoring force of the spring(6).

A support plate(21) is formed on the upper end of the post(2) to form a recessed shape, and an insertion part(31) connected to the lower end of the head(3) is fastened to the support plate(21) by a bolt(22) so that the head(3) is mounted on the upper end of the post(2).

The head(3) is formed with cut parts(32) cut in a plurality of places on a cylindrical side surface, and a plate(33) having an outlet(331) is mounted on each of the cut parts (32), and a belt(5) is drawn out through the outlet(331). A handle(51) having a width larger than that of the outlet(331) is fixed to an end of the belt so as not to enter the inside of the head through the outlet(331).

In the lower part of the head(3), an upper housing(36) is fixed to the inside of the upper part of the head 3 by plate members(33) and screws(36'). A lower housing(34) accommodating a spring is positioned on a support protrusion(35) of the lower part of the head(3), of which an outer surface is in close contact with an inner surface of the housing. A lower end of a side wall of the lower housing(34) protrudes from an inner side of the lower parts of the head(3), A spool(4) is arranged at the lower housing(34) by rotatably inserting an end part(41') protruded dwonward from the lower plate(41) of the spool(4) into the hole(341) formed in the center of the lower housing(34).

The upper end(43') of a central shaft part(43) protrudes above the upper plate(42) of the spool(4) and is rotatably inserted into the boss(44') extending downward from the center of the cover(44) provided on the upper housing(36) so that the spool may be rotated.

A spring(6) such as a clockwork is disposed in the recess(343) formed to be lower than the upper end of the sidewall of the bottom plate(342) of the lower housing(34). One end of the spring(6) is fixed to the protruding end(41') of the lower plate(41) of the spool(4) and the other end is fixed to the side wall of the lower housing(34), As a result, as described later, the spring(6) is elastically wound by the spool rotated as the belt(5) is drawn out by the user, and thus has a restoring force in the direction of unwinding, thereby rewinding the belt(5).

In the spool(4), a lower plate(41) and an upper plate(42) are integrally formed at the lower end and the upper end of the central shaft part(43), respectively, and a belt(5) is wound around the central shaft part. One end of the belt is fixed to the central shaft part(43), and the other end is disposed outside through an outlet(331) formed on a head.

As the safety means, two divided annular holders(37, 37') are arranged on the upper surface of the upper plate(42) of the spool(4), and a plurality of grooves(38, 38') are formed in each of the holders. In the illustrated embodiment, three grooves(38, 38') are formed, and metal balls(39, 39') having a diameter smaller than the diameter of the grooves are arranged in each groove(38, 38'). The holders(37, 37') are spaced apart from each other so as to move radially inwardly and outwardly on the upper plate(42) and over the inner space of the upper housing(36).

Two locking parts(45) protruding from the upper surface of the upper plate(42) of the spool(4) are formed between the adjacent both ends of the holders(37, 37'), so that the two holders(37, 37') disposed on the upper surface of the upper plate(42) of the spool(4) are rotated upon rotation of the spool(4). At this time, the holders(37, 37') move in a radial direction outward from the upper surface of the spool(4) by centrifugal force of the metal balls(39, 39') disposed in the grooves(38, 38') of the holders(37, 37'), and frictional force is generated as the holders(37, 37') contact closely to the inner surface of the upper housing(36) fixed to the plate(33) by the screws(36') in the upper inner side of the head(3).

In this way, when the belt(5) withdrawn form the housing is rewound around the spool(4), the holders(37, 37') arranged on the upper surface of the rotating spool(4) are rotated, and the holders(37, 37') move radially outward by the centrifugal force of the balls(39, 39'). As a result, the holders move radially outward to be in close contact with the inner surface of the upper housing so that the spool is decelerated, and thus the speed of the belt(4) rewinding to the spool is also decelerated.

Accordingly, as a safety means according to the present invention, the holders move outward in the radial direction by the centrifugal force of the balls provided in the grooves of the holders places in the upper housing, so that the holders move radially outward to be in close contact with the inner surface of the upper housing to reduce the rewinding speed of the belt. Therefore, problems such as safety accidents caused by the free end of the belt that has not been decelerated in the prior art are prevented.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

INDUSTRIAL AVAILABILITY

This invention can be used to prevent safety accidents that occur when belts rewound in a barrier post for maintaining order by restricting outsiders' access to construction sites or work sites or guiding people's movement paths at events.

DESCRIPTION OF THE REFERENCE NUMERALS

1: stand
2: post
3: head
4: spool
5: belt

6: spring
36: upper housing
37,37'; holder
38,38': groove
39,39': ball
42: upper plate
45: locking part

The invention claimed is:

1. A barrier post with a safety means comprising:

the barrier post fixed to a stand, a cylindrical head mounted on an upper end of the barrier post, a spool provided in the head, a belt wound on the spool so as to be withdrawn from the spool and inserted to a second spool provided in a second head of an adjacent barrier post, a spring that is compressed when the belt is drawn out from the spool and that acts on the spool to automatically rewind the belt on the spool after use via a restoring force exerted by the compressed spring, and the safety means for reducing rotation of the spool by the spring when the belt is rewound to the spool by the restoring force of the spring, wherein the safety means comprises two divided annular holders with a plurality of grooves arranged on an inner space of an upper housing included in the head, wherein a metal ball is provided in each groove of the plurality of grooves, wherein two locking parts protruding from an upper surface of an upper plate of the spool are formed between adjacent ends of the two divided annular holders holders, so that the two divided annular holders may be rotated together with the spool by the restoring force of the spring and wherein when the spool is rotated by the restoring force of the spring, a rewind speed of the belt is decelerated as the holders also rotate and move outward in the radial direction from the upper surface of the spool due to a force exerted by the metal balls in the plurality of grooves such that the holders reduce the rewind speed of the belt.

2. The barrier post with the safety means of claim 1, wherein an upper end of a central shaft part protrudes above the upper plate of the spool and is rotatably inserted into a boss extending downward from a center of a cover provided on the upper housing so that the spool may be rotated.

* * * * *